US006469601B1

(12) United States Patent
Miura et al.

(10) Patent No.: US 6,469,601 B1
(45) Date of Patent: Oct. 22, 2002

(54) UNDER-VOLTAGE TRIPPING DEVICE WITH EARLY-OPERATION AUXILIARY SWITCH FOR CIRCUIT BREAKER

(75) Inventors: Masao Miura, Saitama (JP); Koji Asakawa, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/127,695

(22) Filed: Apr. 23, 2002

(30) Foreign Application Priority Data

Apr. 27, 2001 (JP) ..... 2001-130818

(51) Int. Cl.[7] ..... H01H 75/00; H01H 77/00; H01H 83/00

(52) U.S. Cl. ..... 335/6; 335/11; 335/13; 335/20

(58) Field of Search ..... 335/6–14, 20, 335/21, 159–163

(56) References Cited

U.S. PATENT DOCUMENTS 6,232,855 B1 * 5/2001 Malingowski et al. ..... 335/14

* cited by examiner

*Primary Examiner*—Ramon M. Barrera
(74) *Attorney, Agent, or Firm*—Kanesaka & Takeuchi

(57) ABSTRACT

An under-voltage tripping device installed on a main body of a circuit breaker includes an electromagnetic under-voltage tripping mechanism; an early-operation auxiliary switch for switching a conductive path of an electromagnet of the electromagnetic under-voltage tripping mechanism in connection with a handle mechanism of the circuit breaker; and a unit case having two opposite ends and external connection terminals at the two opposite ends thereof. The unit case is shaped to fit an outward frame of the main body. The wiring circuits for the electromagnet and the early-operation auxiliary switch are separated from each other in the unit case. The early-operation auxiliary switch is connected between the external connection terminals of the unit case, and the electromagnet has leads emerging directly from the unit case and connected to an external wiring.

5 Claims, 8 Drawing Sheets

Fig. 3
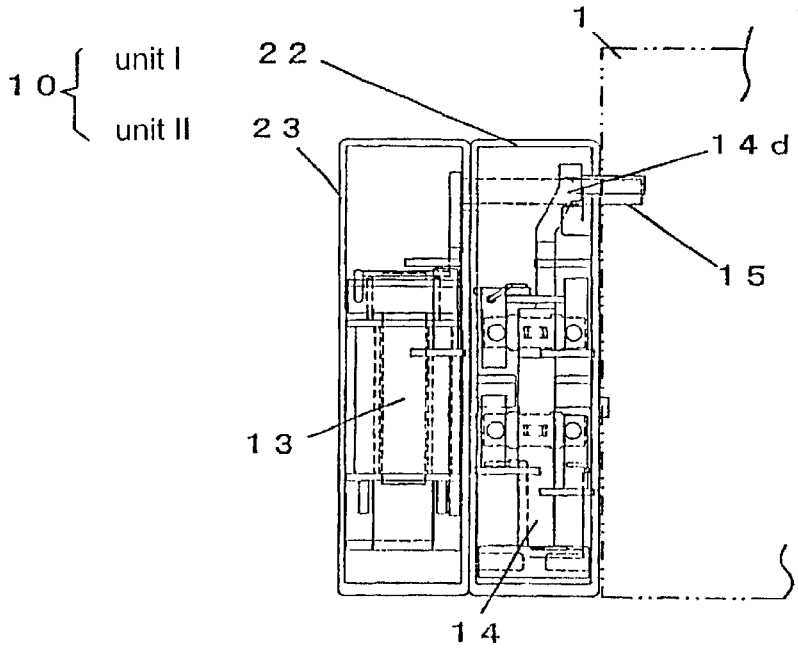
Fig. 4(a)
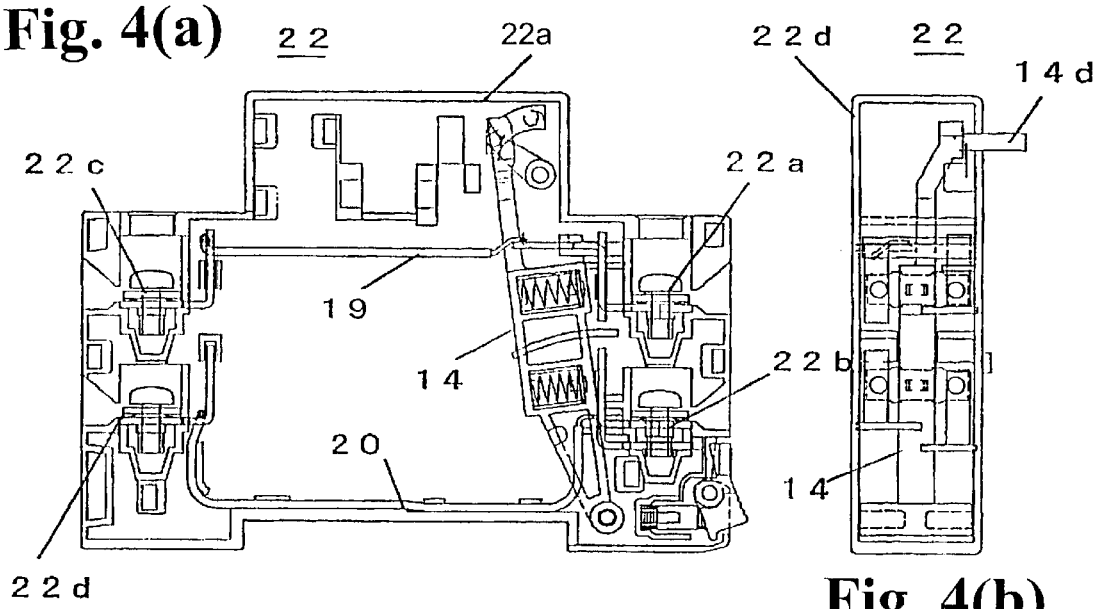
Fig. 4(b)
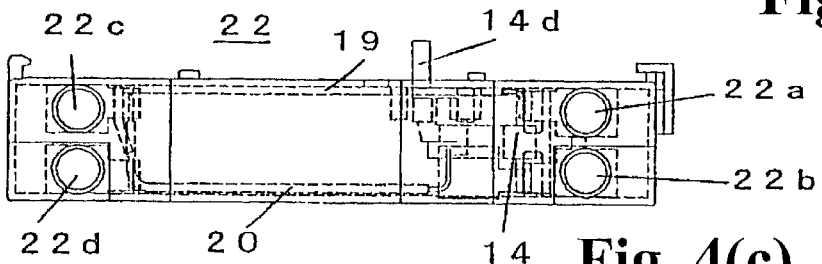
Fig. 4(c)

Fig. 5(a)
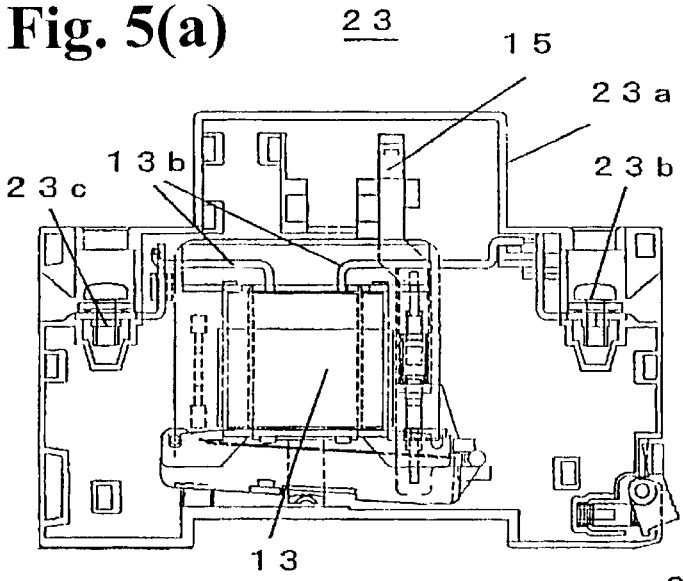
Fig. 5(b)
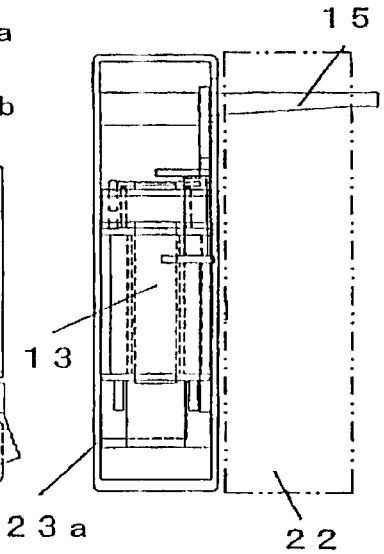
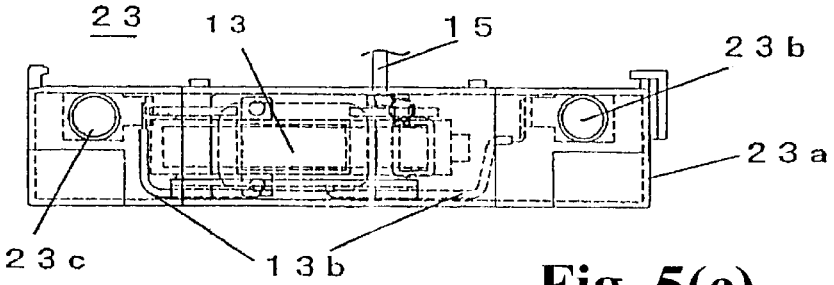
Fig. 5(c)

Fig. 6
Prior Art
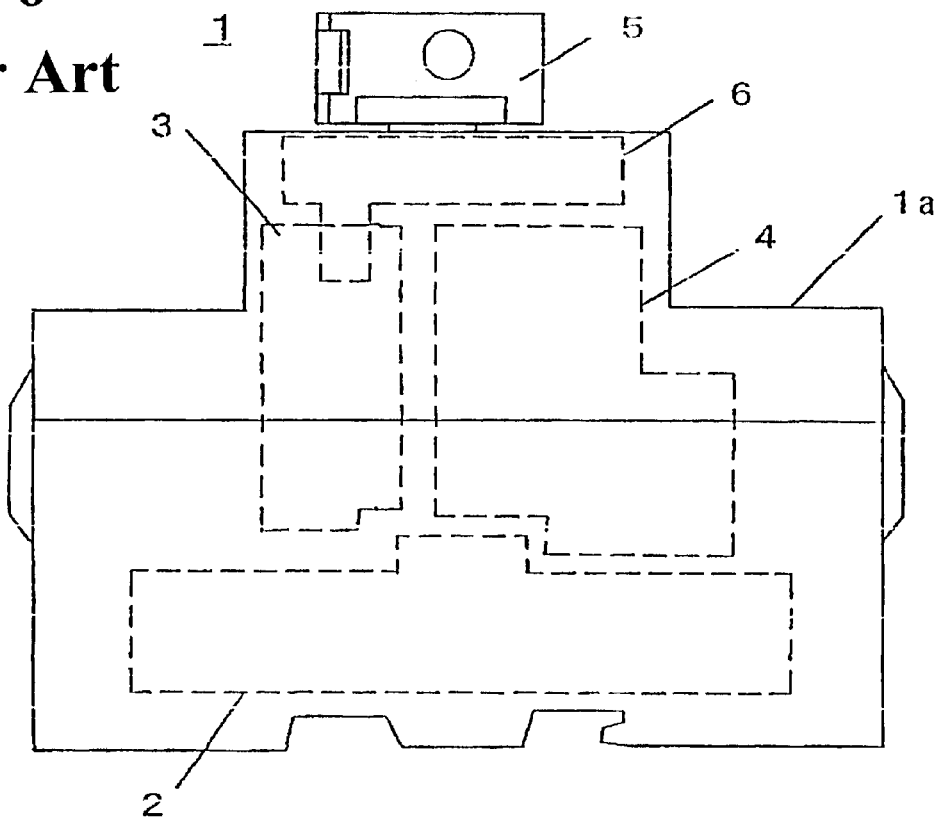
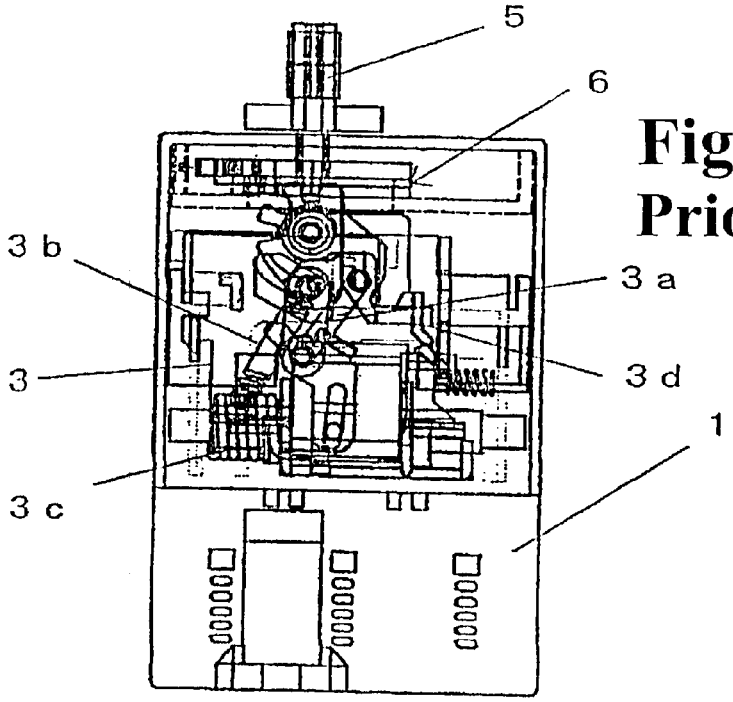
Fig. 7
Prior Art

UNDER-VOLTAGE TRIPPING DEVICE WITH EARLY-OPERATION AUXILIARY SWITCH FOR CIRCUIT BREAKER

BACKGROUND OF THE INVENTION AND RELATED ART STATEMENT

The present invention relates to an under-voltage tripping device with an early-operation auxiliary switch that is used as an external accessory for general-purpose, low-capacity circuit breaker, e.g. a molded case circuit breaker (auto-breaker) for controlling an electric motor.

The above molded case circuit breaker is provided with various optional accessories, including an under-voltage tripping device. The under-voltage tripping device is installed on a side of a breaker main body and linked with an internal mechanism of the main body so as to trip the breaker when the voltage at the main circuit decreases excessively during conduction.

Furthermore, an under-voltage tripping device with an early-operation auxiliary switch is known, in which an under-voltage tripping mechanism composed of an electromagnet and a tripping lever, and an early-operation auxiliary switch connected to a conductive circuit of the electromagnet and linked with a handle mechanism of the breaker, are combined and built into a single unit case, so that when the handle is operated to close a main circuit contact of the circuit breaker after the breaker has performed a tripping operation, the early-operation auxiliary switch can be turned on to reset the circuit breaker. This under-voltage tripping device with an early-operation auxiliary switch is used to simultaneously break the main circuit and a circuit for the under-voltage tripping device if the circuit breaker is applied to a circuit for emergency stop of loads on an electric motor or the like.

Before explaining the under-voltage tripping device with the early-operation auxiliary switch contact, a configuration of a circuit breaker, e.g. auto-breaker, is shown in FIGS. 6 and 7. In FIG. 6, reference number 1 denotes a circuit breaker, 1*a* is a case of the breaker main body, 2 is a current-interrupting section provided with a main circuit contact and an arc-extinguishing chamber, 3 is an opening-and-closing mechanism section for the main circuit contact, 4 is an over-current tripping device, and 5 is a rotary operation handle disposed on a cover top surface of the case 1*a*. The operation handle 5 constitutes a handle mechanism that connects a gear mechanism 6 linking the operation handle 5 with the contact opening-and-closing mechanism 3 to a reset cam for controlling a drive lever for the early-operation auxiliary switch of an under-voltage tripping device (accessory).

Opening and closing operations of the circuit breaker 1 are well known. When the operation handle 5 is rotated from the OFF position to the ON position, a toggle link mechanism 3*a* of the contact opening-and-closing mechanism section 3 operates via the gear mechanism 6 to close the main circuit contact of the current interrupting section 2 via an opening and closing spring 3*b* and an opening and closing lever 3*c*. Conversely, when the operation handle 5 is rotated from the ON position to the OFF position, the toggle link mechanism 3*a* and the opening and closing lever 3*c* operate in an opposite way to open the main circuit contact of the current interrupting section 2. Furthermore, when an over-current flows through the main circuit and causes the over-current tripping device 4 to release a latch mechanism 3*d* of the contact opening-and-closing mechanism section 3, the opening-and-closing mechanism section 3 opens the main circuit contact to interrupt the current. In this regard, the operation handle 5 follows this trip operation to stop at a TRIP position midway between the ON position and the OFF position, thereby indicating that the circuit breaker has performed a trip operation.

Furthermore, after the breaker has performed the trip operation, when it is tried to set the breaker after the main circuit has been restored to a normal condition, the operation handle 5 is returned from the TRIP position to the RESET position (same as the OFF position) in order to reset the latch mechanism 3*d* of the contact opening-and-closing mechanism 3. The operation handle 5 is then rotated to the ON position to close the main circuit contact in order to set the breaker.

Next, a basic structure and operation of the under-voltage tripping device with the early-operation auxiliary switch as an accessory, which is installed on a side of the main body of the circuit breaker for use, will be described with reference to FIGS. 8 and 9.

The under-voltage tripping device 10 is installed on a side of the case 1*a* of the circuit breaker 1 as an independent unit. A unit case 11 (the case 11 is made in a dimension so as to ensure that it does not protrude from the outward frame of the breaker main body) has external connection terminals (screw terminals) 12*a* to 12*d* arranged at the respective lateral ends thereof in different stages. The case contains the under-voltage tripping mechanism composed of a combination of an electromagnet 13 and a tripping lever 15 connected to the electromagnet, and an early-operation auxiliary switch 14 that opens and closes a conductive circuit for the electromagnet 13 in connection with the operation of a handle mechanism of the breaker main body. The external connection terminals 12*a* to 12*d* are arranged in different stages to facilitate a wiring operation required to install these terminals on a distribution board or a control board when connecting them to bus bars and branch bars of the main circuit laid in the board.

The tripping lever 15 has one end connected to an armature 13*a* of the electromagnet 13, and a drive pin 15*a* drawn out laterally from the upper end of the lever through the unit case 11 is linked with a tripping plate assembled on the contact opening-and-closing mechanism section 4 of the breaker main body. Reference number 15*b* denotes a return spring that forces the tripping lever 15 downward.

The early-operation auxiliary switch 14 is composed of two vertical sets of early-operation contacts, each of which include a pair of fixed contacts 14*a* and a bridge-shaped movable contact 14*b* bridging the fixed contacts 14*a*, and an oscillating contact holder 14*c* that supports the movable contacts 14*b* together with contact springs and journals the lower ends of the movable contacts. An operating lever 14*d*, which operates in connection with the contact holder 14*c*, is located at the upper end of the switch 14 and linked with a drive lever 16 integrated into a handle section of the breaker main body. Furthermore, the drive lever 16 is operated in connection with a reset cam 17 connected to the operation handle 5.

Furthermore, inside the case of the under-voltage tripping device 10, the above described external connection terminals 12*a* to 12*d* are wired as follows: the terminal 12*a* is connected to the terminal 12*c* through the upper early-operation contact of the early-operation auxiliary switch 14 and a coil of the electromagnet 13, and the terminal 12*b* is connected to the terminal 12*d* via the lower early-operation contact of the early-operation auxiliary switch 14. In operation, when the under-voltage tripping device is attached to the circuit breaker 1, the external connection terminals 12*a* and 12*b* are wired to the power supply side of the main circuit, while the other external connection terminals 12*c* and 12*d* are directly connected together, as shown in FIG. 10.

In the above configuration, when the operation handle 6 of the circuit breaker 1 is rotated to the ON position, the early-operation auxiliary switch 14 of the under-voltage tripping device 10 is turned on via the drive lever 16 to supply power from the main circuit to the electromagnet 13 of the tripping mechanism, thereby allowing electric conduction through the electromagnet 13. In this case, if voltage in the main circuit is normal, the attraction of the electromagnet 13 causes the tripping lever 15 to be pushed up against the spring force of the return spring 15*b*, and the drive pin 15*a* moves backward from the tripping plate of the opening-and-closing mechanism of the circuit breaker to maintain the main circuit contact in a set state. On the other hand, when the voltage in the main circuit decreases excessively, the spring force of the return spring 15*b* overcomes the attraction force of the electromagnet 13 to push the tripping lever 15 downward. Therefore, the tripping lever 15 pushes the tripping plate down to release the latch mechanism of the opening-and-closing mechanism. This causes the circuit breaker to perform the trip operation.

Furthermore, when the circuit breaker 1 is manually reset after a trip operation, the operation handle 5 is returned from the TRIP position to the OFF position and then rotated to the ON position. During this operation, the early-operation auxiliary switch 14 is turned on via the drive lever 16 operating in connection with the operation handle 5, thereby conducting electricity through the electromagnet 13. This conduction causes the armature 13*a* to attract the tripping lever 15 and pull it backward. Thus, the opening-and-closing mechanism section 3 of the circuit breaker is reset, and when the operation handle 5 is subsequently moved to the ON position, the main circuit contact of the current interrupting section 2 is closed.

The above-described under-voltage tripping device is connected to the main circuit of the circuit breaker 1 in order to apply the main circuit voltage to the electromagnet 13, as shown in FIG. 10. With this wiring method, if the main circuit voltage is high, the coil of the electromagnet 13 must conform to a high-voltage specification corresponding to the main circuit voltage. Therefore, to allow an under-voltage tripping device conforming to a standard specification to be applied to a high-voltage circuit breaker, a wiring method is required in which a transformer 18 is interposed between the early-operation auxiliary switch 14 and the electromagnet 13 so as to decrease the main circuit voltage, which is then applied to the electromagnet 13, as shown in FIG. 11.

When the wiring method shown in FIG. 11 is applied to the standard specification under-voltage tripping device 10 with the early-operation auxiliary switch described in FIGS. 8 and 9, wiring problems occur. That is, the under-voltage tripping device in FIGS. 8 and 9 comprises the four terminals 12*a* to 12*d*, each of which is connected to a corresponding end of the case 11 as external connection terminal, and the electromagnet 13 and early-operation auxiliary switch 14 are internally wired in series. Accordingly, the transformer 18 can not be externally connected unless it is modified.

In order to apply to the wiring method in FIG. 11, some products have an internal wiling configuration as described below. Namely, additional external connection terminals (screw terminals) 12*e* and 12*f* are installed in the case of the under-voltage tripping device 10 below the above-described external connection terminals 12*a* to 12*d*, and leads 13*b*, drawn out from the coil of the electromagnet 13 integrated into the case, are connected to the terminals 12*e* and 12*f*, as shown in FIG. 12. And, the early-operation auxiliary switch 14 is connected between the terminals 12*a* and 12*c* via a connection line 19, and a connection line 20 is used to connect the terminals 12*b* and 12*d*.

With this configuration, the wiring method in FIG. 11 can be accommodated by externally connecting a primary coil of the transformer 18 (see FIG. 11) between the external connection terminals 12*c* and 12*d*, while connecting a secondary coil between the external connection terminals 12*e* and 12*f*.

However, with the configuration in FIG. 12, the addition of the external connection terminals 12*e* and 12*f* increases the outside height H of the case 11 as compared to the standard under-voltage tripping device shown in FIG. 9. Thus, no problem occurs when the under-voltage tripping device is applied to a large circuit breaker, but in the case of a small circuit breaker, as its height is larger than the outside height of the circuit breaker, the under-voltage tripping device can not be installed in the breaker main body.

In other words, when a plurality of circuit breakers is installed on a distribution board or a control board, they are arranged and supported on support rails laid on the board, and their operation handles are made to protrude outward from a door of the board. This makes it nearly impossible to install tall under-voltage tripping devices in short circuit breakers.

The present invention has been made to resolve the above issues and to provide the under-voltage tripping device with the early-operation auxiliary switch that has the same size as existing standard under-voltage tripping devices and that also has an improved wiring structure in order to accommodate both wiring methods shown in FIGS. 10 and 11.

Further objects and advantages of the invention will be apparent from the following description of the invention.

SUMMARY OF THE INVENTION

According to the present invention, the above object can be achieved using the following aspects.

The first aspect of the invention provides an under-voltage tripping device with an early-operation auxiliary switch for a circuit breaker that is installed on a side of a breaker main body as an accessory to the circuit breaker. In the under-voltage tripping device, an electromagnetic under-voltage tripping mechanism and an early-operation auxiliary switch that opens and closes a conductive path for an electromagnet of the mechanism in connection with the operation of a handle mechanism of the circuit breaker are assembled in a single unit case comprising external connection terminals disposed at each of the opposite ends thereof. The single unit case is shaped to fit an outside frame of a breaker main body, and a wiring circuit for the electromagnet and a wiring circuit for the early-operation auxiliary switch are separated from each other in the unit case. The early-operation auxiliary switch is connected between the external connection terminals disposed at one end of the case and the external connection terminals disposed at the other end, and the electromagnet has leads drawn out directly from the case and connected to an external wiring.

In the second aspect of the invention, the unit case is shaped to fit the outside frame of the breaker main body, and the wiring circuit for the electromagnet and the wiring circuit for the early-operation auxiliary switch are separated from each other in the unit case. The early-operation auxiliary switch is connected between the external connection terminals disposed at one end of the case and the external connection terminals disposed at the other end, and the electromagnet has leads connected to the external wiring via a terminal block installed on one side of the unit case.

The above configuration uses the leads drawn out from the electromagnet coil contained in the case, or the terminal block disposed on the side of the case and connected to the leads. Accordingly, this configuration can be applied to the wiring method shown in FIG. 11 by connecting a transformer between the external connection terminals disposed at one end of the case and the external connection terminals disposed at the other end. Without any transformer, the leads from the electromagnet coil can be externally wired to the external connection terminals provided at the respective ends of the case.

Furthermore, the third aspect of the present invention provides another configuration wherein the under-voltage tripping device with the early-operation auxiliary switch is divided into two units. That is, the under-voltage tripping mechanism and early-operation auxiliary switch are separated and built into a unit case shaped to fit the outside frame of a breaker main body and comprising external connection terminals disposed at each of the opposite ends thereof. The two units are placed side by side and installed on a side of the breaker main body. In this installed state, the under-voltage tripping mechanism unit and early-operation auxiliary switch unit operate in connection with the breaker main body.

BRIEF DESCRIPTION OF THE DRAWINGS

FIG. 3 is a side view of an internal structure of an under-voltage tripping device with an early-make auxiliary switch corresponding to another embodiment of the present invention, in which units of the device are piled together;

FIGS. 4(*a*)–4(*c*) are detailed views of the structure of unit I in FIG. 3, wherein FIGS. 4(*a*) to 4(*c*) are a front view, a side view, and a plan view, respectively, of the structure;

FIGS. 5(*a*)–5(*c*) are detailed views of the structure of unit II in FIG. 3, wherein FIGS. 5(*a*) to 5(*c*) are a front view, a side view, and a plan view, respectively, of the structure;

FIG. 6 is a schematic view of a configuration of a circuit breaker to which the under-voltage tripping device of the present invention is to be applied;

FIG. 7 is a detailed view of a structure of a set opening-and-closing mechanism in FIG. 6;

DETAILED DESCRIPTION OF PREFERRED EMBODIMENTS

Figure 8:
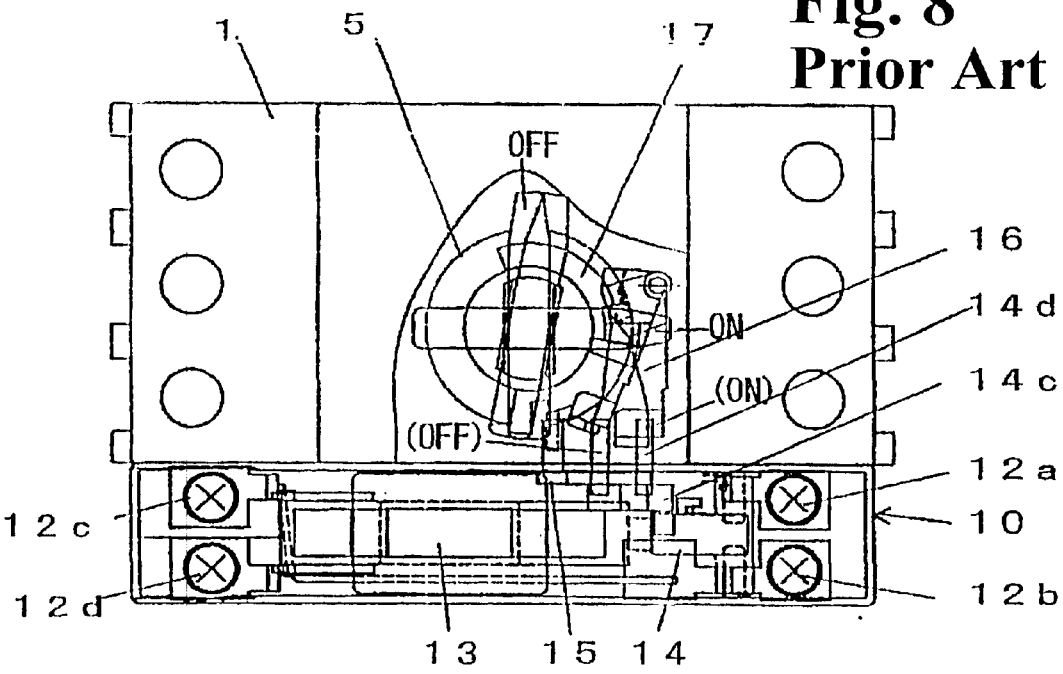
Fig. 8 Prior Art
FIG. 8 is a plan view showing a conventional standard under-voltage tripping device with an early-operation auxiliary switch that is installed in a circuit breaker.
Figure 9:
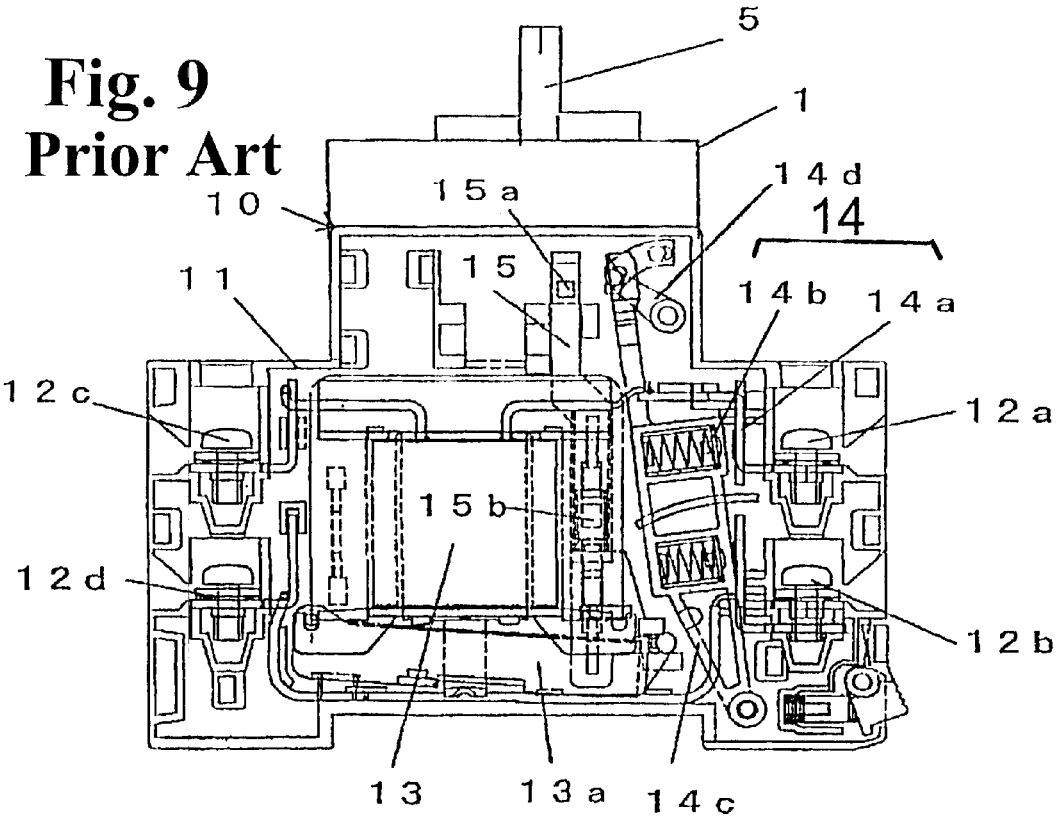
Fig. 9 Prior Art
FIG. 9 is a front view of the internal structure of the under-voltage tripping device in FIG. 8.

Hereunder, embodiments of the present invention will be described below with reference to the accompanied drawings. In the drawings, parts corresponding to the parts shown in FIGS. 8 and 9 are denoted by the same reference numbers, and their description is omitted.

Figure 1A:
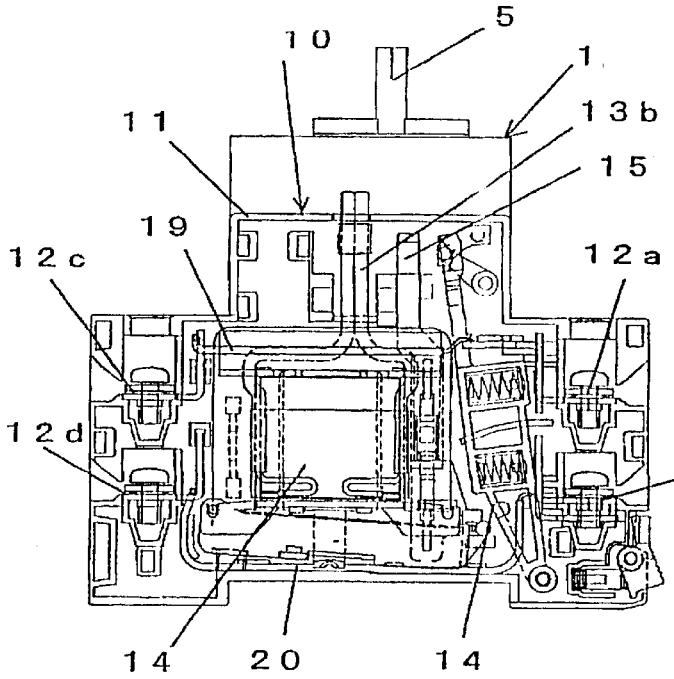
FIGS. 1(*a*)–1(*c*) are views showing a configuration of an under-voltage tripping device with an early-operation auxiliary switch corresponding to an embodiment of the present invention, wherein FIG. 1(*a*) is a front view of an internal structure of the under-voltage tripping device in combination with a circuit breaker, FIG. 1(*b*) is a side view thereof, and FIG. 1(*c*) is a plan view thereof.
Figure 1B:
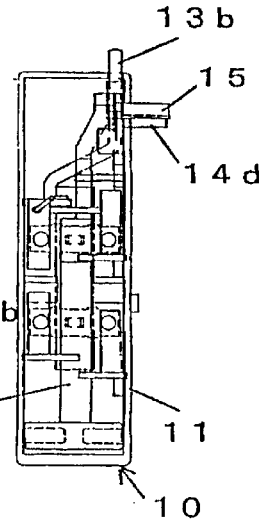
Figure 1C:
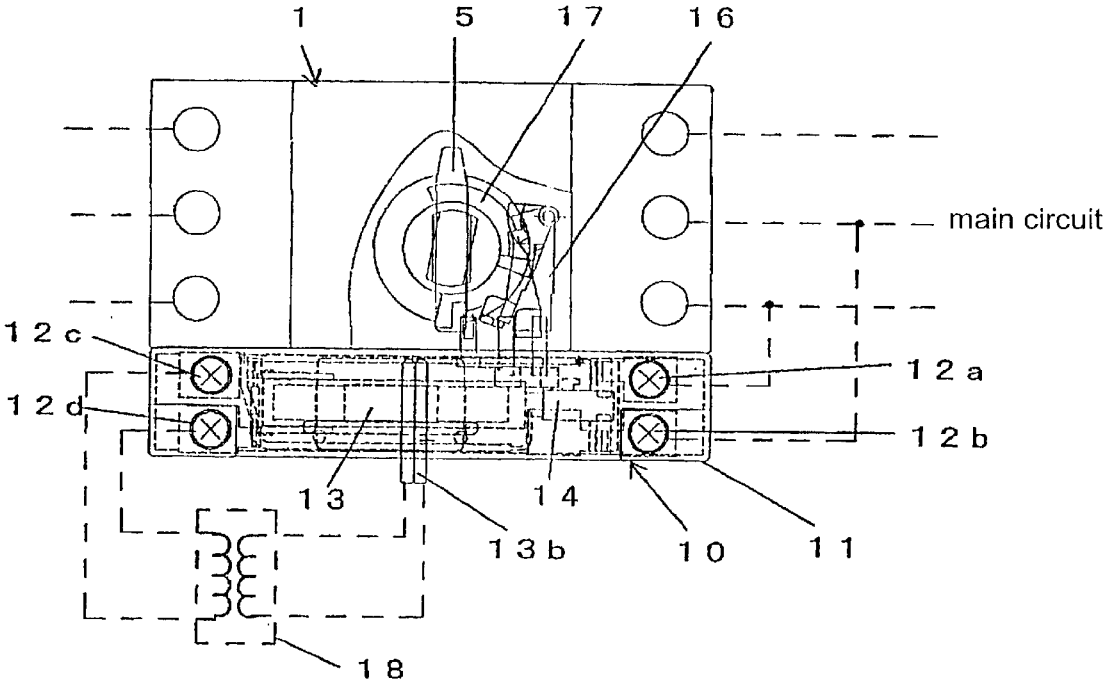

FIGS. 1(*a*)–1(*c*) show a first embodiment corresponding to the first aspect of the present invention. In this embodiment, an under-voltage tripping device 10 with an early-operation auxiliary switch has a structure essentially similar to that of the standard under-voltage tripping device described in FIGS. 8 and 9 except for an internal wiring. A single unit case 11 shaped according to the outside frame of a circuit breaker 1 has an electromagnet 13, an early-operation auxiliary switch 14, a tripping lever 15 integrated therein, and external connection terminals 12*a* to 12*d*, each of which is arranged at a corresponding lateral end of the single unit case 11 at different stages.

The single unit case 11 has an internal wiring structure as follows. That is, a conductive circuit for the electromagnet 13 is separated from the early-operation auxiliary switch, and coil leads 13*b* from respective ends of a coil on the electromagnet 13 are drawn out directly from the upper center of the single unit case 1l and connected to an external circuit. In between the external connection terminals 12*a* to 12*d* located at both ends of the single unit case 11, the terminals 12*a* and 12*c* are connected by a connection conductor 19 via contacts of the early-operation auxiliary switch 14, and the terminals 12*b* and 12*d* are connected by a connection conductor 20 via contacts of the early-operation auxiliary switch 14.

Figure 10:
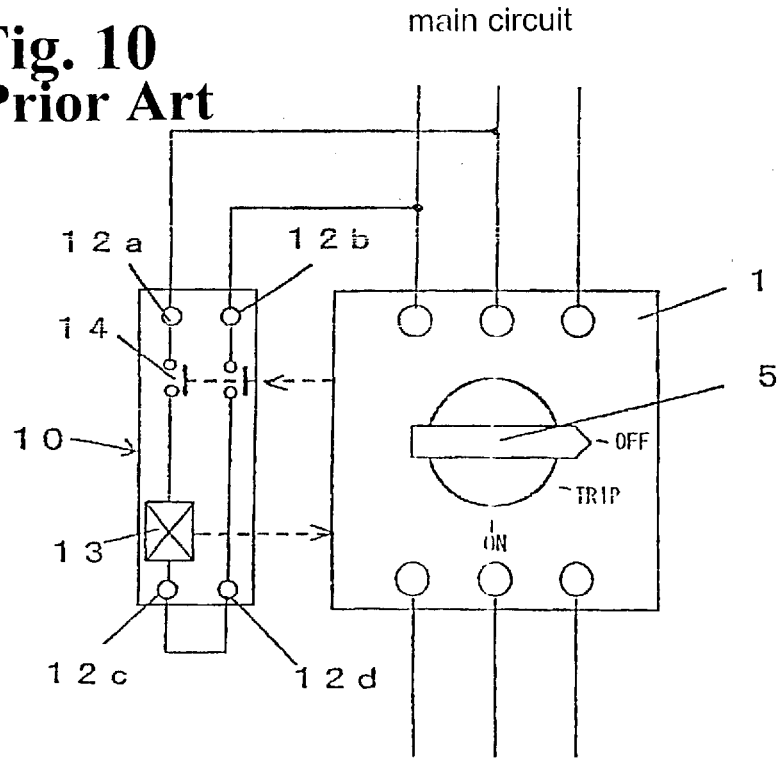
Fig. 10 Prior Art
FIG. 10 is a wiring diagram showing a general wiring method for an under-voltage tripping device with an early-operation auxiliary switch that is attached to a circuit breaker.
Figure 11:
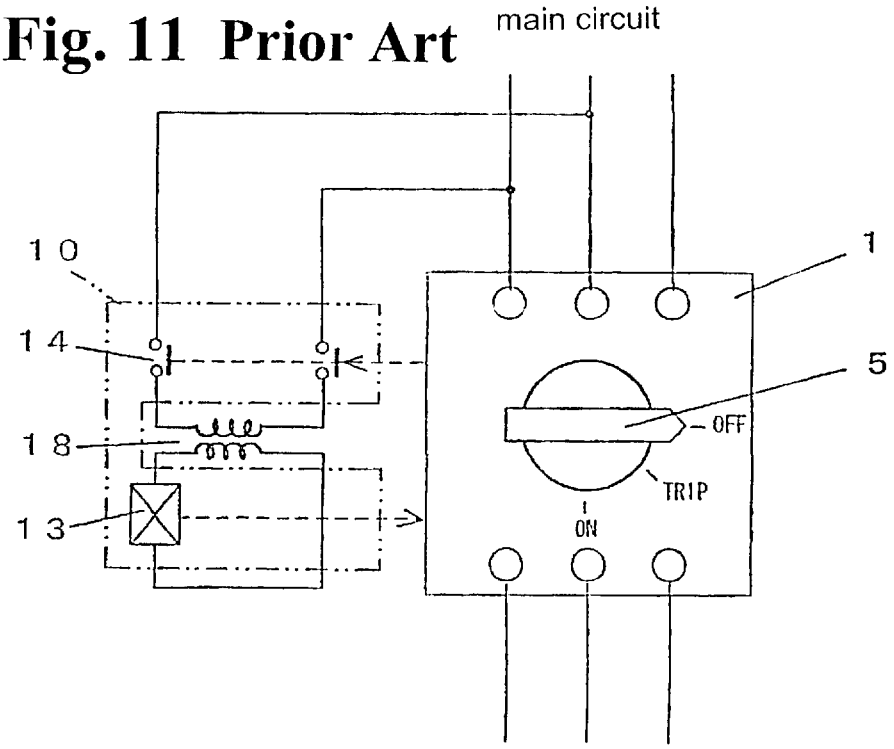
Fig. 11 Prior Art
FIG. 11 is a wiring diagram showing a wiring method different from that in FIG. 10.

In an operational state in which the under-voltage tripping device 10 is installed in the circuit breaker 1, when a transformer 18 is interposed and wired between the early-operation auxiliary switch 14 and the electromagnet 13 as in the wiring method shown in FIG. 11, the right terminals 12*a* and 12*b* are connected to the main circuit, as shown in FIG. 1(*c*). Then, a primary coil of the transformer 18 is wired between the left terminals 12*c* and 12*d*, and a secondary coil of the transformer 18 is connected to the coil leads 13*b* from the electromagnet 13 drawn out from the case. Further, when the wiring method shown in FIG. 10, which does not include the transformer 18, is used, the coil leads 13*b* from the electromagnet 13 are connected to the external connection terminals 12*c* and 12*d*, both of which are located at the left ends of the case 11.

Figure 12:
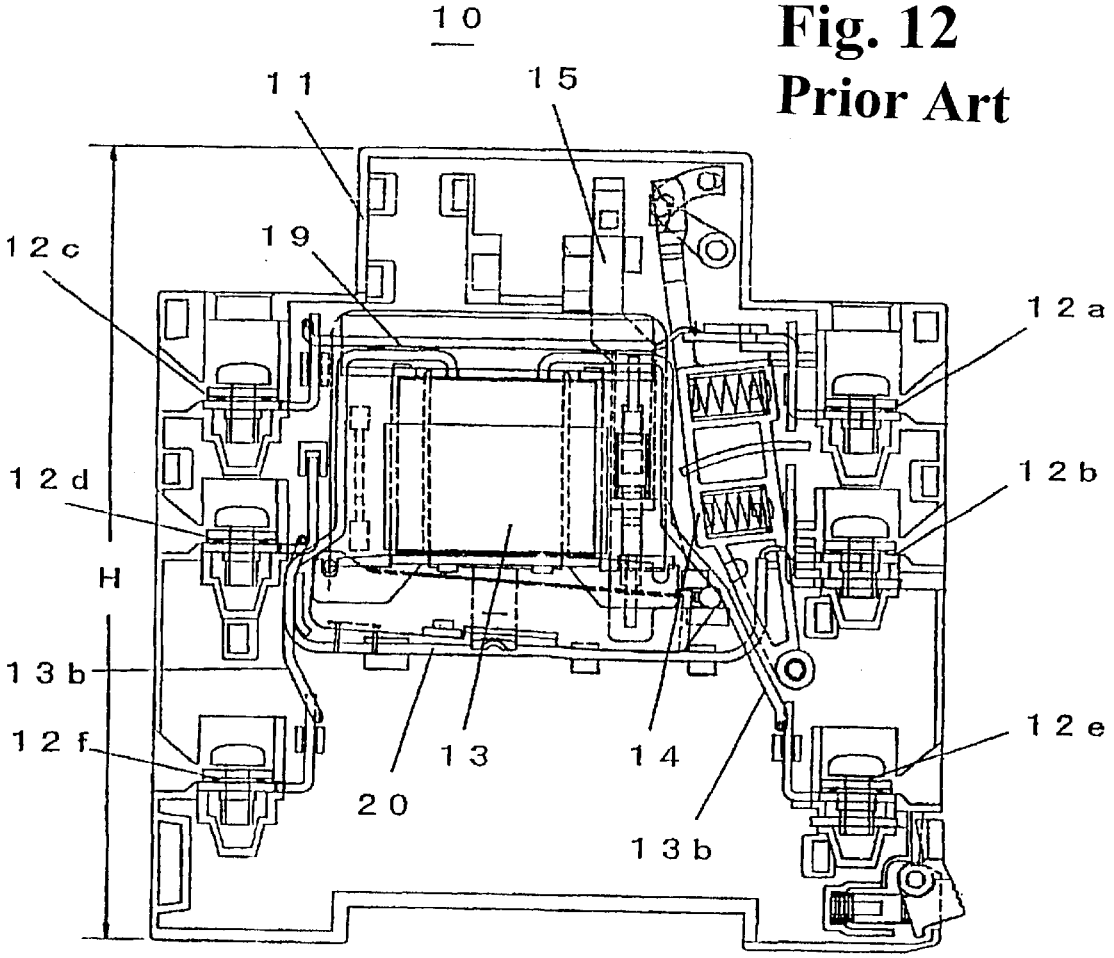
Fig. 12 Prior Art
FIG. 12 shows an internal structure of a conventional under-voltage tripping device with an early-operation auxiliary switch that has been manufactured in accordance with the wiring method shown in FIG. 11.

The above configuration does not require the height H of the unit case 11 of the under-voltage tripping device to be increased in order to provide a space for external connection terminals 12*e* and 12*f* corresponding to the electromagnet 13, as shown in FIG. 12. Thus, the under-voltage tripping device 10 can have outside dimensions similar to those of the standard device shown in FIG. 9, allowing installation in the small circuit breaker 1 of a low capacity so as to accommodate both wiring methods shown in FIGS. 10 and 11.

Figure 2A:
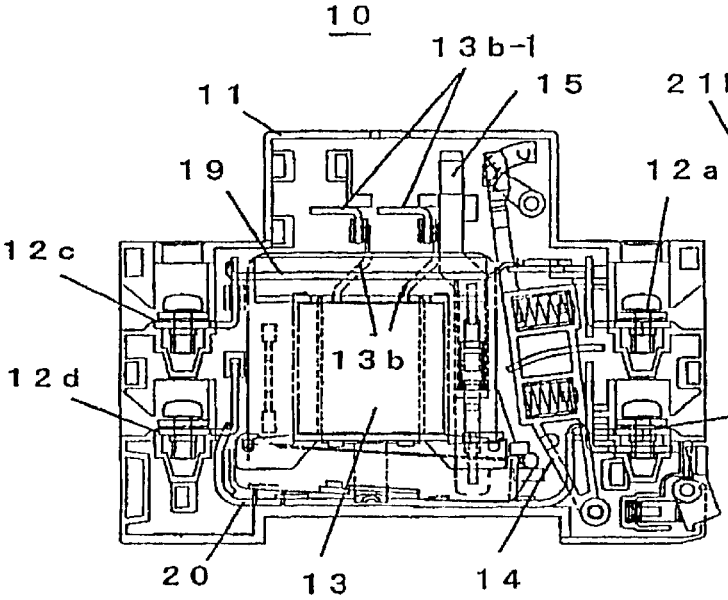
FIGS. 2(*a*)–2(*c*) are views showing a configuration of an under-voltage tripping device with an early-operation auxiliary switch corresponding to another embodiment of the present invention, wherein FIG. 2(*a*) is a front view of an internal structure thereof, FIG. 2(*b*) is a side view thereof, and FIG. 2(*c*) is a plan view thereof.
Figure 2B:
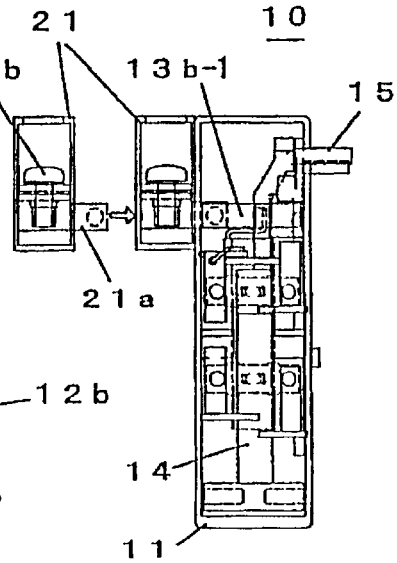
Figure 2C:
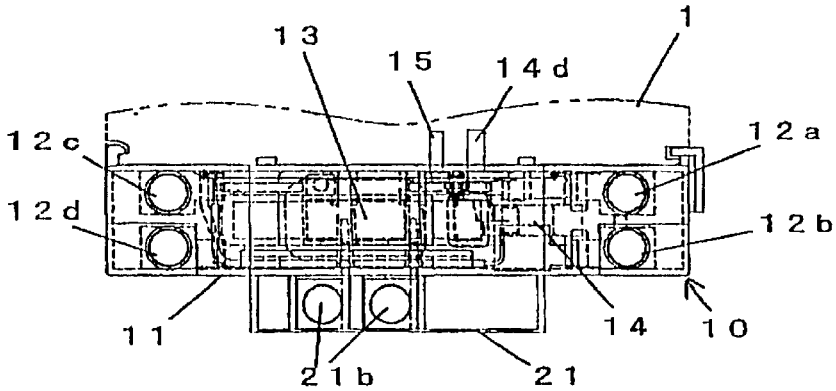

FIG. 2(*a*)–2(*c*) show a second embodiment corresponding to the second aspect of the present invention as a modification of the first embodiment. In this embodiment, socket terminal fixtures 13*b*-1 are attached to the tips of the coil leads 13*b* drawn out from the coil on the electromagnet 13 inside the unit case 11 and are connected to an external wiring via a detachable terminal block 21 installed on the upper part of the unit case 11 and coupled to the terminal fixtures 13*b*-1.

The terminal block 21 has plug-shaped terminal fixtures 21*a* and screw terminals 21*b* attached thereto. The terminal fixtures 21*a* are inserted into the case through slots opened on the side of the case of the under-voltage tripping device 10 and are coupled to the terminal fixtures 13*b*-1 of the coil leads 13*b*. The external wiring is then connected to the screw terminals 21*b* of the terminal block 21. Thus, while the under-voltage tripping device has outside dimensions similar to those of the circuit breaker 1, as in the first embodiment, it can accommodate both wiring methods shown in FIGS. 10 and 11.

A third embodiment corresponding to the third aspect of the present invention will be described below with reference to FIGS. 3(*a*)–3(*c*) to FIGS. 5(*a*)–5(*c*). In this embodiment, the under-voltage tripping device 10 with the early-operation auxiliary switch is divided into two units 22 and 23. One unit ("unit I") contains the early-operation auxiliary switch 14, whereas the other unit ("unit II") contains an under-voltage tripping mechanism composed of a combination of the electromagnet 13 and the tripping lever 15. The units 22 and 23 have unit cases 22*a* and 23*a* formed to fit the outside frame of the circuit breaker 1. As shown in FIGS. 3(*a*)–3(*c*), the units I and II are placed side by side and installed on a side of the circuit breaker 1.

Furthermore, the unit I, containing the early-operation auxiliary switch 14, has external connection terminals 22*b*, 22*c*, 22*d*, and 22*e* so that the external connection terminals 22*b* and 22*c* are arranged at one lateral end of the unit case 22*a* at different heights, whereas the external connection terminals 22*d* and 22*e* are arranged at the other lateral end of the unit case 22*a* at different heights. Inside the case, the terminals 22*b* and 22*d* are connected together by the connection conductor 19 via the contacts of the early-operation auxiliary switch 14, whereas the terminals 22*c* and 22*e* are connected together by the connection conductor 20 via the contacts of the early-operation auxiliary switch 14.

The unit II, containing the under-voltage tripping mechanism, has external connection terminals 23*b* and 23*c* provided at the respective lateral ends of the unit case 23*a*, and coil leads 13*b* drawn out from the respective ends of the coil on the electromagnet 13 integrated into the case are connected to the terminals 23*b* and 23*c*, respectively, as shown in FIGS. 5(*a*)–5(*c*).

Furthermore, in the case that the unit I is located close to the circuit breaker 1 and the unit II is located away from of the circuit breaker 1 as shown in FIG. 3(*a*)–3(*c*), a tip of a protrusion extending horizontally from the upper end of the tripping lever 15 integrated into the unit II can be inserted into the breaker main body, and a rectangular slot is opened in a side wall of the unit I so as to allow the lever 15 to penetrate the unit case 22*a*.

When the wiring method shown in FIG. 10 is applied, the external connection terminals 22*b* and 22*c* of the unit I, containing the early-operation auxiliary switch 14, are wired to the main circuit. Other wires are used to connect the external connection terminals 23*b* and 23*c* of the unit II, containing the under-voltage tripping mechanism, to the external connection terminals 22*d* and 22*e* of the unit I. When the wiring method shown in FIG. 11 is applied to connect the transformer 18 to the main circuit, then the primary coil of the transformer 18 is connected between the external connection terminals 22*d* and 22*e* of the unit I, whereas the secondary coil thereof is connected between the external connection terminals 23*b* and 23*d*.

As in the above embodiments, both wiring methods shown in FIGS. 10 and 11 can be easily accommodated while installing the units I and II, which constitute the under-voltage tripping device 10, so that the units I and II do not protrude from the outside frame of the circuit breaker 1. Furthermore, without using the unit I containing the early-operation auxiliary switch 14, only the unit II can be connected directly to the main circuit of the circuit breaker.

As described above, the present invention has the following features. According to the configurations set forth in the first and second aspects, by using the existing under-voltage tripping device conforming to the standard specifications with the early-operation auxiliary switch as a base and changing only parts of the internal wiring of the device, the present invention can be easily applied not only to the wiring method shown in FIG. 10, but also to the wiring method shown in FIG. 11, which uses a transformer in combination. Furthermore, the under-voltage tripping device with the early-operation auxiliary switch can be installed in a small circuit breaker such as an auto-breaker controlling an electric motor, which can then be integrated into a distribution board or the like. Consequently, the present invention can provide the very practical under-voltage tripping device with the early-operation auxiliary switch.

The configuration set forth in the third aspect of the present invention has features similar to those of the above configurations. Furthermore, since the device is divided into the unit I containing the early-operation auxiliary switch and the unit II containing the under-voltage tripping mechanism, only the unit II is installed in the circuit breaker to enable the functions similar to those of the typical under-voltage tripping device.

While the invention has been explained with reference to the specific embodiments of the invention, the explanation is illustrative and the invention is limited only by the appended claims.

What is claimed is:

1. An under-voltage tripping device installed on a circuit breaker with a handle mechanism, comprising:

a unit case having two opposite ends, external connection terminals at the two opposite ends, and a shape to be fixed to the circuit breaker, said unit case including an electromagnetic under-voltage tripping mechanism having an electromagnet with a conductive path and a wire circuit; and an early-operation auxiliary switch for switching the conductive path of the electromagnet of the electromagnetic under-voltage tripping mechanism in connection with the handle mechanism of the circuit breaker, said early-operation auxiliary switch having a wire circuit separated from that of the electromagnetic under-voltage tripping mechanism and being arranged between the external connection terminals at the two ends, said electromagnet having leads emerging directly from the unit case and connected to an external wiring.

2. An under-voltage tripping device according to claim 1, further comprising a terminal block installed on a side of the unit case, said leads of the electromagnet being connected to the external wiring through the terminal block.

3. An under-voltage tripping device according to claim 1, wherein said unit case includes a first casing containing the electromagnetic under-voltage tripping mechanism, and a second casing containing the early-operation auxiliary switch and fixed adjacent to the first casing.

4. An under-voltage tripping device according to claim 3, wherein said first casing includes additional terminals to be connected to the leads of the electromagnet.

5. An under-voltage tripping device installed on a circuit breaker with a handle mechanism, comprising:

a unit case including a first casing having first external connection terminals at two opposite ends and a shape to be fixed to the circuit breaker, and containing an electromagnetic under-voltage tripping mechanism; and a second casing having second external connection terminals at two opposite ends, a shape to be fixed to the circuit breaker, and containing an early-operation auxiliary switch, said first and second casings being arranged side by side and fixed to a side surface of the circuit breaker so that the electromagnetic under-voltage tripping mechanism and the early-operation auxiliary switch are linked to be associated with a mechanism of the circuit breaker.

* * * * *